US007096530B2

(12) United States Patent
Goulet

(10) Patent No.: US 7,096,530 B2
(45) Date of Patent: Aug. 29, 2006

(54) PAINT ROLLER WITH EXTENDABLE HANDLE

(75) Inventor: Matthew G. Goulet, Milwaukee, WI (US)

(73) Assignee: Newell Operating Company, Freeport, IL (US)

( * ) Notice: Subject to any disclaimer, the term of this patent is extended or adjusted under 35 U.S.C. 154(b) by 431 days.

(21) Appl. No.: 10/658,080

(22) Filed: Sep. 9, 2003

(65) Prior Publication Data

US 2005/0050663 A1 Mar. 10, 2005

(51) Int. Cl.
*B05C 17/02* (2006.01)
*B25G 1/04* (2006.01)

(52) U.S. Cl. ..... 15/144.4; 15/230.11; 16/429

(58) Field of Classification Search ..... 15/144.4, 15/144.3, 230.11; 16/429, 422, 427; 492/13, 492/19

See application file for complete search history.

(56) References Cited

U.S. PATENT DOCUMENTS 3,153,252 A * 10/1964 Ricciardi ..... 15/144.4
3,266,144 A * 8/1966 Fishlove ..... 30/322
5,598,598 A 2/1997 Sorenson
5,864,918 A * 2/1999 Kosick ..... 15/248.2
5,881,601 A 3/1999 Hammer
6,546,596 B1 * 4/2003 Grote et al. ..... 16/429
6,588,065 B1 7/2003 Tucker

* cited by examiner

*Primary Examiner*—Gladys J P Corcoran
*Assistant Examiner*—Shay L. Balsis
(74) *Attorney, Agent, or Firm*—Taft, Stettinius & Hollister, LLP

(57) ABSTRACT

An extendable handle for a paint applicator includes an first shaft having a distal end and a proximal end and a second shaft with a distal end and a proximal end and which is telescopically disposed within the first shaft. A guide block is disposed on the second shaft and defines a curved channel. A third shaft has a distal end and a proximal end and is telescopically disposed within the second shaft. An advancement strip has a first end connected to the distal end of the first shaft and a second end connected to the proximal end of the third shaft and is disposed through the curved channel of the guide block. The advancement strip can both push and pull the third shaft relative to the second shaft.

17 Claims, 13 Drawing Sheets

PAINT ROLLER WITH EXTENDABLE HANDLE

FIELD OF THE DISCLOSURE

The present disclosure relates to painting accessories and, more specifically, relates to paint rollers and extension poles.

BACKGROUND OF THE DISCLOSURE

Painting apparatuses generally called paint rollers are known in which a cylindrical paint brush is fitted on to a roller. The roller is rotatably connected to a handle such that a user can roll the cylindrical paint brush along a wall surface to transfer paint from the paint brush to the wall surface. In the most common design, the handle is only one to two feet long.

In many painting applications, it is necessary for the user to access hard-to-reach locations. For example, with interior painting of walls and the like, a user typically can not reach the ceiling of the room simply with an out-stretched arm and a typical paint roller. Accordingly, ladders and scaffolding are commonly employed in such situations. While effective, they are relatively expensive alternatives, and are relatively difficult to assemble and move about a work site. Furthermore, a dangerous situation can easily arise in which a user leans to far away from the ladder and could possibly tip over and injure him or herself.

Accordingly, it is often the situation that a user will employ an extension pole to which the paint roller can be attached. For example, paint rollers can be provided with a handle having a plurality of internal threads at a base thereof. A pole having a complementary diameter and a series of external threads can therefore be threadably attached to the paint roller to thus increase the reach of the user. However, in order to provide a secure attachment between the pole and the paint roller, a relatively large number of threads are provided and thus a relatively large number of rotations are received for the pole to be fully attached and detached from the paint roller. If the user is moving back and forth between a situation wherein the extension pole is needed and not needed, he or she is therefore confronted with attaching and detaching the pole from the paint roller a number of times during the painting process. This necessarily slows the work flow and can be frustrating to the user.

Such extension poles are also often advantageously employed with accessories other than paint rollers, such as but not limited to, pad painters, paint brushes, dusting tools, light bulb changers, etc. While such accessories often have threaded handles, the threads may be provided at various dimensions or pitches, especially due to the multiple manufacturers of such devices. Adapters for each, or extension poles for each, have therefore been required to connect to each different thread configuration.

Other handles have been developed in which the user slides multiple cylinders that telescope over each other to extend the handle. These cylinders are independent of each other, and so to extend the handle to its full length, the user must extend each cylinder relative to the next one. This may take several steps, and the user may even need to grab the paint roller mat or wire area supporting the roller mat in order to extend it relative to the last cylinder. While effective, this may undesirably dirty the hand of the user.

Figure 1:
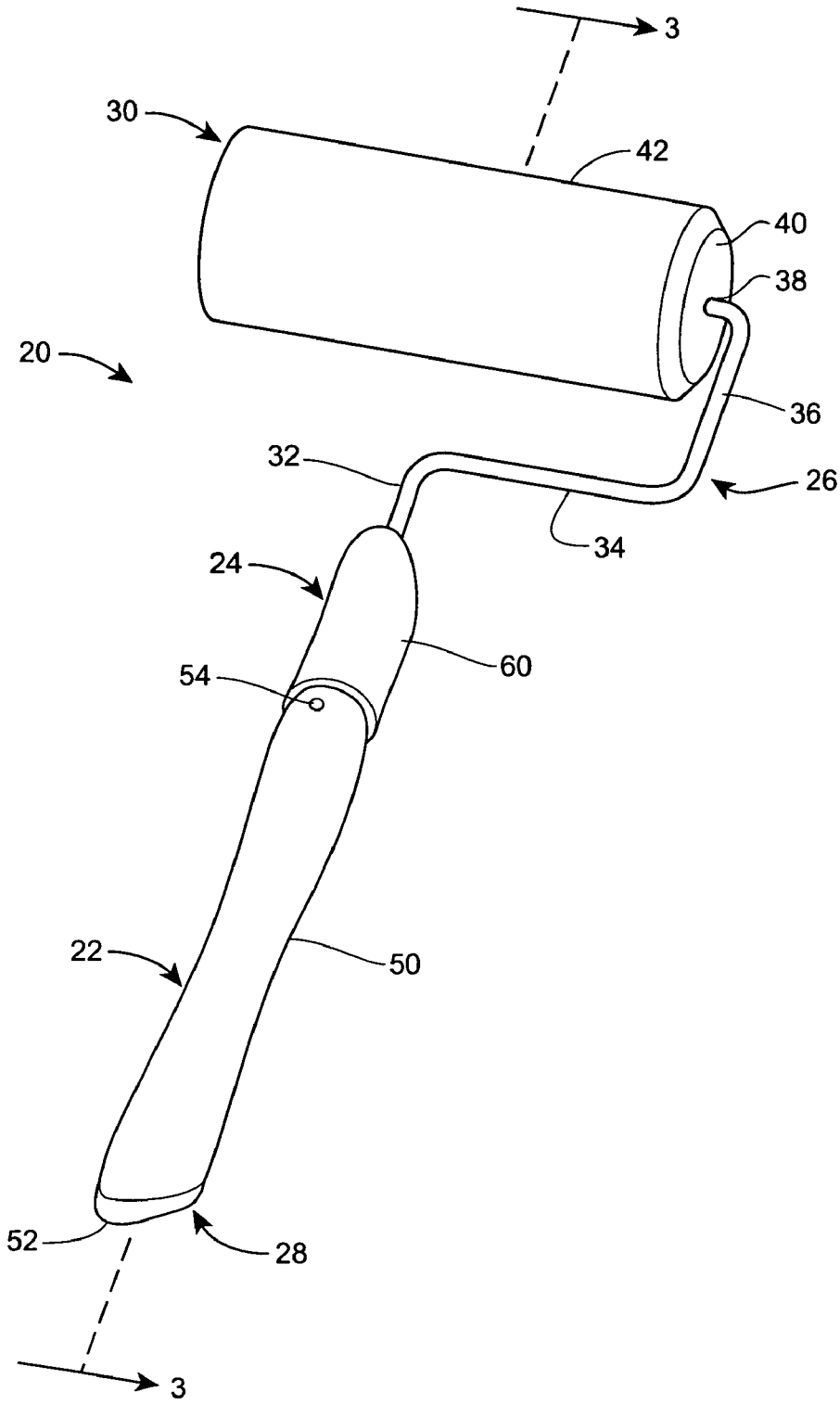
FIG. 1 is a perspective view of a paint roller in a retracted position constructed in accordance with the teachings of this disclosure.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and the equivalents falling within the spirit and scope of the invention as defined by the appended claims.

DETAILED DESCRIPTION

Figure 2:
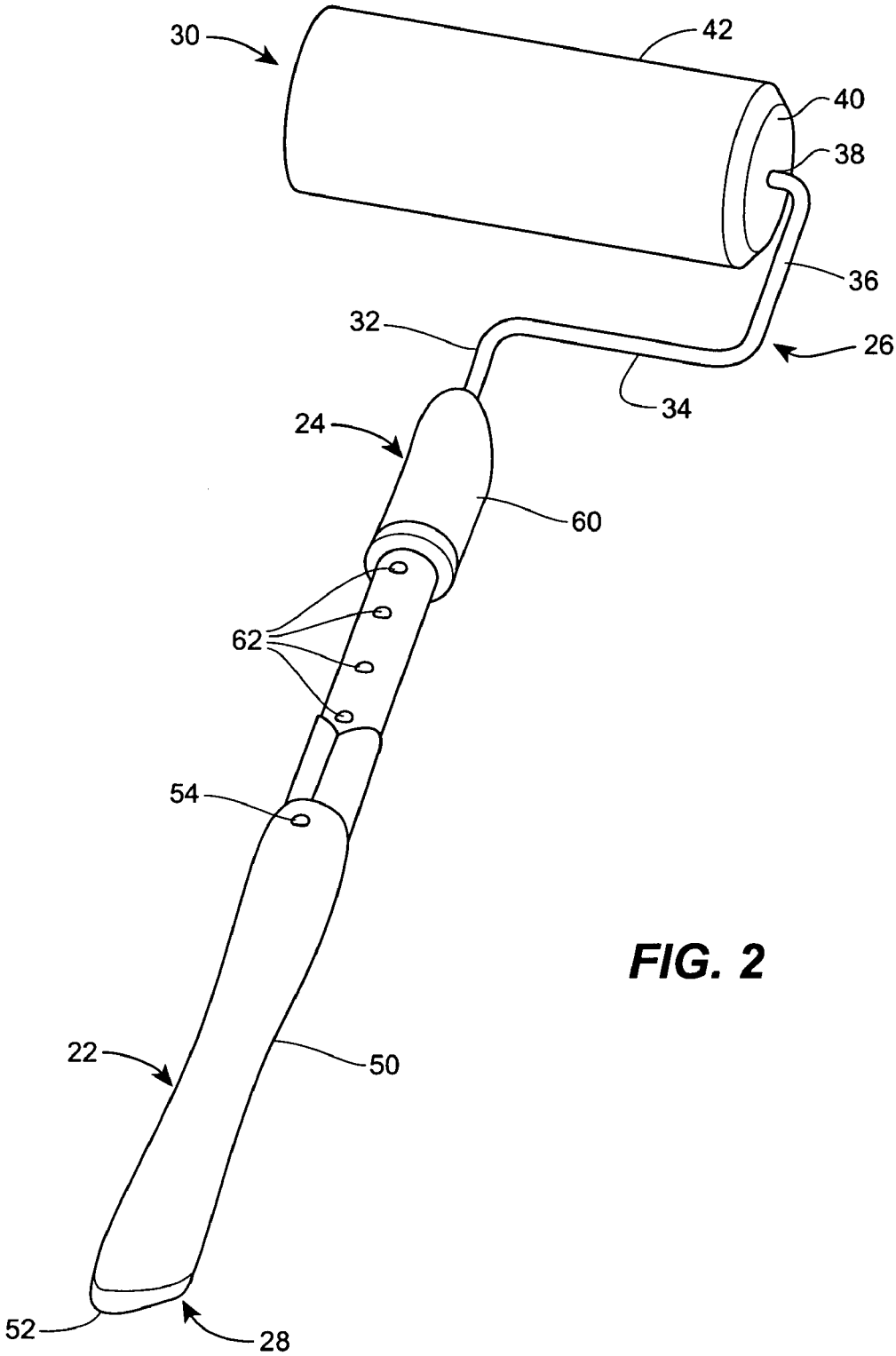
FIG. 2 is a perspective view of the paint roller of FIG. 1 in an extended position.

Referring now to the drawings, and in particular to FIGS. 1 and 2, a paint applicator 20 is disclosed. The paint applicator 20 includes a first handle section 22, a second handle section 24, and an implement section 26. The second handle section 24 can telescope within the first handle section 22, and the implement section 26 can telescope within the second handle section 24 such that the implement section 26 and second handle section 24 can move from a retracted position, shown in FIG. 1, to an extended position, shown in FIG. 2. The paint applicator 20 includes a proximal end 28 and a distal end 30.

The implement section 26 includes a main leg 32, an offset leg 34, a spacer leg 36, and a mounting leg 38. Rotatably disposed on the mounting leg 38 is a mounting spool 40 that is configured to support a paint roller 42. The paint roller 42 can be mounted on the mounting spool 40 by an interference fit such that the paint roller 42 does not slip on the mounting spool 40 while in use. One of ordinary skill in the art will readily recognize the mounting spool 40 may include first and second ends between which a plurality of metal spokes extend in a common "cage" configuration or may be a molded plastic piece of unitary design with a plurality of radially extending protrusions adapted to grip the roller 42.

Figure 3:
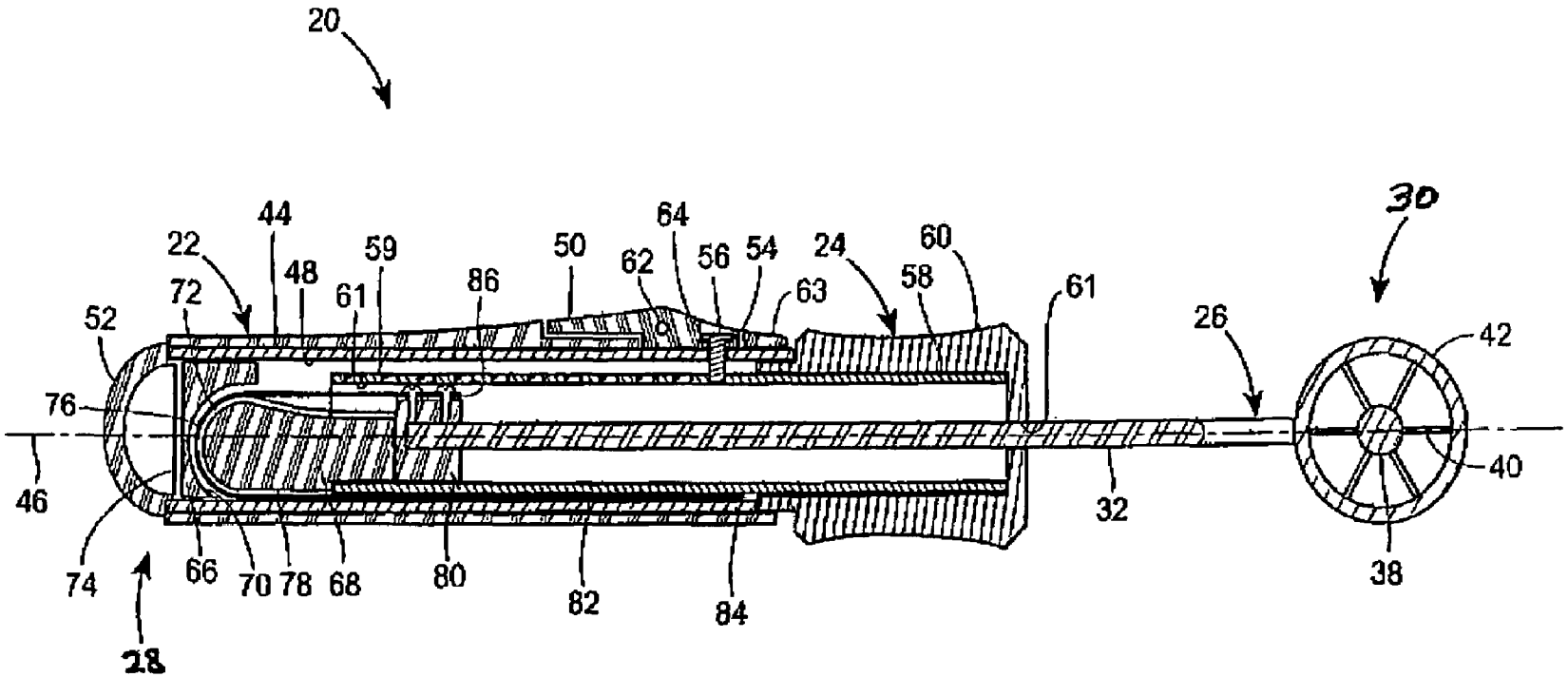
FIG. 3 is a cross-sectional view of the paint roller taken along line 3—3 in FIG. 1.

Referring now to FIG. 3, the first handle section 22 includes an outer cylinder 44 that defines a central axis 46. The outer cylinder 44 has an inner surface 48 and can be a tubular member that allows for another member to be slidable within it. The outer cylinder 44 can be manufactured from any material that is durable, such as polyethylene, polypropylene, nylon, fiberglass, aluminum, steel, etc. While an outer cylinder 44 having a circular cross section is disclosed herein, it is clear that other cross sectional shapes, such as rectangular, oval, triangular, etc. are within the scope of this disclosure.

Mounted on the outer cylinder 44 is a first grip 50. The first grip 50 can have an ergonomic design such that the user is able to easily grip the first handle section to thereby abate hand fatigue. The first grip 50 can be manufactured from a material that is comfortable to hold, such as Santoprene.RTM. A butt cap 52 can be mounted to the proximal end of the outer cylinder 44 to conceal the mechanics of the paint applicator 20. Air relief holes can be included in the butt cap to allow air to escape from inside the paint applicator 20. A locking hole 54 can be disposed in the outer cylinder 44 to accommodate a locking pin 56, as will be described later.

The second handle section 24 includes an inner cylinder 58 with an inner surface 59 and an outer surface 61 that is disposed within and slidable relative to the outer cylinder 44. The inner cylinder 58 can also be a tubular member that allows for another member to be slidable within its hollow core. The inner cylinder 58 can be manufactured from any material that is durable, such as polyethylene or polypropylene. While an inner cylinder 58 having a circular cross section is disclosed herein, it is clear that other cross sectional shapes, such as rectangular, oval, triangular, etc. are within the scope of this disclosure. Although it is shown in this example that the outer cylinder 44 and the inner cylinder 58 have the same cross sections, this is not necessary.

Mounted on the distal end of the inner cylinder 58 is a second grip 60. The second grip 60 can also have an ergonomic design such that the user is easily able to grip the second handle section 24 and reduce hand fatigue as with the first grip 50. The second grip 60 can be manufactured from a material that is comfortable to hold, such as Santoprene.RTM. The second grip 60 can extend around the distal end of the inner cylinder 58 and form an opening 61 through which the implement section 26 can slide. The opening can be sized to ensure that no paint enters the inside of the paint applicator 20, or can include a wiper or a scraper.

A sleeve bearing 63 can be disposed on the distal end between the outer cylinder 48 and the inner cylinder 58. The sleeve bearing 63 ensures that no paint or other debris can enter the gap between the outer cylinder 48 and the inner cylinder 58, while allowing the inner cylinder 58 and the outer cylinder 48 to slide relative to one another.

A plurality of receiver holes 62 can be disposed in the inner cylinder 58 to accommodate the locking pin 56. The user can lock the outer cylinder 44 relative to the inner cylinder 58 in a desired position by inserting the locking pin 56 through the locking hole 54 in the outer cylinder 44 and through one of the plurality of holes 62 in the inner cylinder 58. The locking pin 56 can be biased by a spring 64 or other mechanism toward the inner cylinder 58 and the central axis 46. In this manner, the locking pin 56 will be urged toward and through the locking hole 54 of the outer cylinder 44 and through the selected one of the plurality of receiver holes 62 in the inner cylinder 58. To move the outer cylinder 44 relative to the inner cylinder 58, the user can pull the locking pin 56 out from the selected one of the plurality of receiver holes 62. As will be seen by those of ordinary skill in the art, the locking hole could be placed in the inner cylinder 58, and the plurality of receiver holes could be placed in the implement section 26 to achieve similar results.

Affixed to the inner cylinder 58 is a guide block 66. The guide block 66 has a curved channel 76 formed therein that defines a pushing surface 70 and a pulling surface 72. A first portion 74 of the curved channel 76 is defined where the pushing surface 70 is opposite the pulling surface. A second portion 78 of the curved channel is defined where the pulling surface 72 is opposite from the outer cylinder 44. In this example, the curved channel 76 has a rectangular cross section.

The guide block 66 has an outer cross section similar to that of the inner surface 48 of the outer cylinder 44. The guide block 66 can include material with a reduced coefficient of friction such that the guide block can slide easily within the outer cylinder. Polymers such as Delrin® have been found to be acceptable. In this example, the guide block 66 positions the inner cylinder 58 within the outer cylinder 48 such that the inner cylinder 58 does not contact or wear against the outer cylinder 48. The guide block 66 can be manufactured in two pieces, with a portion of the curved channel 76 milled out of both halves, or the entire curved channel 76 milled out of one of the pieces. The pieces can then be mated.

Slidably disposed within the hollow core of the inner cylinder 58 is the implement section 26. Affixed to the distal end of the main leg 32 of the implement section 26 is a mounting block 80. The mounting block 80 generally can have a cross section similar to the hollow core of the inner cylinder 58 such tat the mounting block 80 can slide smoothly within the inner cylinder 58.

An advancement strip 82 is affixed to the distal end of the inner surface 48 of the outer cylinder 44 at its first end 84. The advancement strip 82 is disposed along the inner surface 48 of the outer cylinder 44 from the distal end towards the proximal end. It travels through the curved channel 76 and back towards the distal end. The advancement strip 82 is affixed on its second end 86 to the mounting block 80. The advancement strip 82 can be affixed on its ends 84,86 by riveting, bonding, screwing, or other ways known in the art.

The advancement strip 82 performs the dual function of both pulling and pushing the implement section 26 through the inner cylinder 58. Thus, the advancement strip 82 should be flexible along its length such that it can curve and slide through the curved channel. The advancement strip 82 must be strong enough to pull the mounting block 80 from the extended position to the retracted position. However, the advancement strip 82 should be resistant to buckling such that it can push the mounting block 80 through the hollow core of the inner cylinder 58 from the retracted position to the extended position, as will be described herein.

It has been found that strips made from spring steel such as those used in retractable tape measures has proven effective. A strip such as this can be arched along its length to provide strength against buckling (See FIG. 21). However, such a strip is also able to flatten out upon entry into the curved channel such that it can easily bend and slide through the curved channel 76. Other strips that can both push and pull and are also resistant to buckling, such as push-pull chains, can also easily be used.

Figure 4:
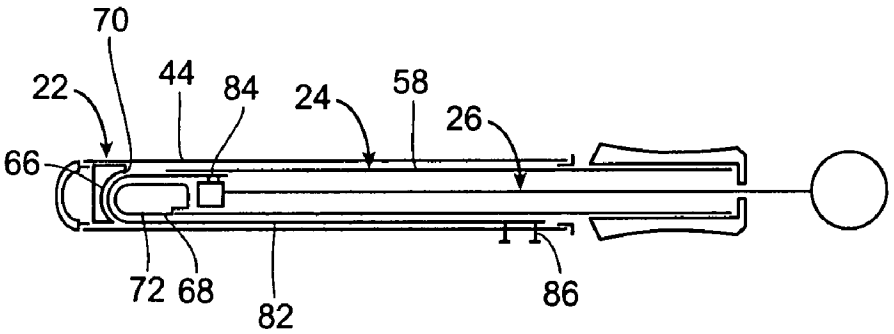
FIG. 4 is a simplified cross-sectional view of the paint roller in the retracted position.
Figure 5:
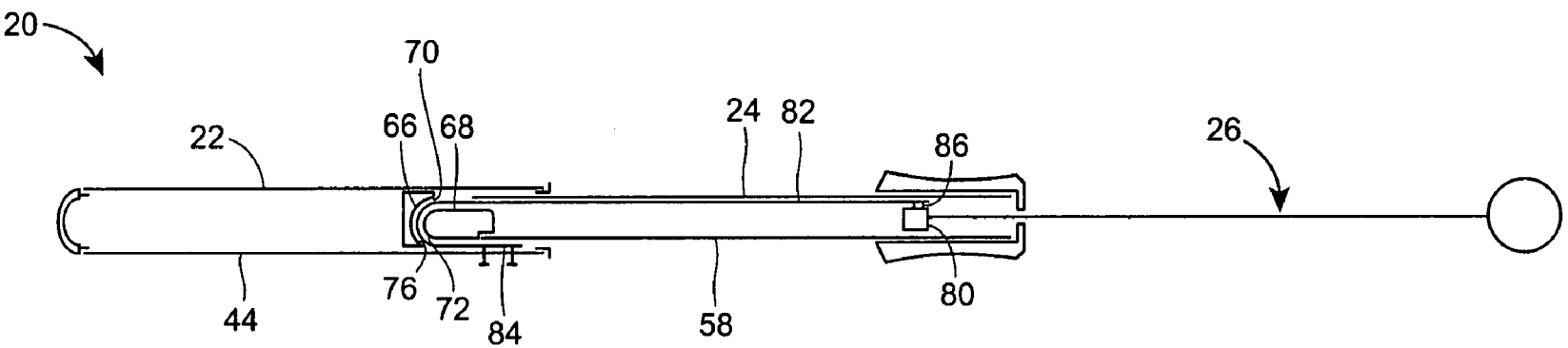
FIG. 5 is a simplified cross sectional view of the paint roller in the extended position.

In use, the paint applicator 20 may be used in the first position as shown in FIGS. 1, 3 and 4. However, if the user needs to paint an area that cannot be reached with the paint applicator 20 in the first position, the paint applicator 20 can be placed in the second position as seen in FIGS. 2 and 5 such that the paint roller 42 is extended an additional distance.

To move the paint applicator 20 into the second position, the user can pull the locking pin 56 from the receiver hole 62 to allow relative motion between the outer cylinder 58 and the inner cylinder 44. The user can then grasp the second grip 60 and the first grip 50 and pull the second handle section 24 distally away from the first handle section 22. The inner cylinder 58 and the guide block 66 are pulled distally relative to the outer cylinder 44. As the guide block 66 is moved towards the distal end of the outer cylinder 44, the advancement strip 82 is forced against the pushing surface 70 of the curved channel 76 and is pushed through the curved channel 76 along the pushing surface 70 such that the advancement strip 82 is forced distally away from the user. Due to its resistance to buckling, the advancement strip 82 pushes the implement section 26 distally through the inner cylinder 58 as it moves through the curved channel 76.

While the second handle section 24 is being moved relative to the first handle section 22, the distance between the first end 84 of the advancement strip 82 and the pushing surface 70 decreases at the same rate the distance between the pushing surface 70 and the second end 86 of the advancement strip 82 increases. Thus, for every unit of distance the second handle section 24 is moved relative to the first handle section 22, the implement section 26 is moved one unit of distance relative to the second handle section 24 and two units of distance relative to the first handle section 22.

To retract the paint applicator 20 from the second position back to the first position, the user simply pulls the second grip 60 back toward the first grip 50. As the guide block 66 is pulled proximally, the advancement strip 82 is pulled tight against the pulling surface 72, and forced to slide through the curved channel 76 thus drawing the implement section 26 proximally relative to the second handle section 24.

Figure 21:
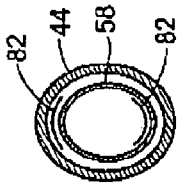
FIG. 21 is a cross sectional view of the paint roller of FIG. 20 taken along line 21—21.
Figure 20:
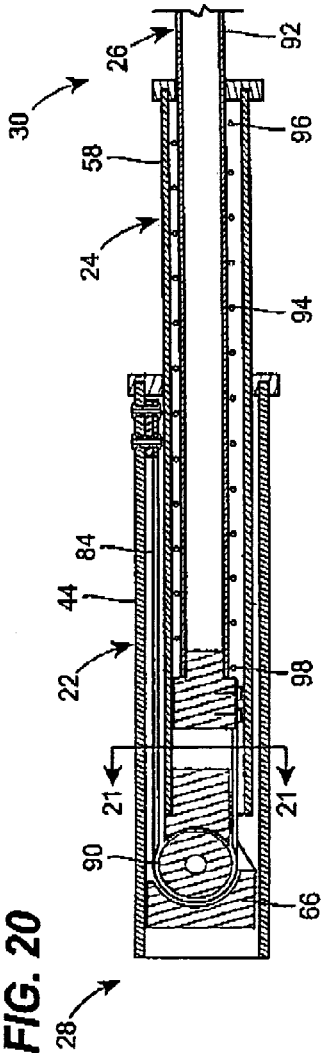
FIG. 20 is a partial cross sectional view of an alternative example of the paint roller of FIG. 1.

In an alternative example, shown in FIGS. 20 and 21, the pulling surface 72 can be replaced with a rotatable pulling wheel 90. The pulling wheel 90 acts as a rotation element bearing to reduce the friction of the advancement strip 82 being pulled through the curved channel 76. In other methods to reduce friction, the curved channel 76 can be lined with a material with a reduced coefficient of friction, such as Delrin®, or the like. Further, the advancement strip 82 can also be covered with an anti-friction coating. In this example, the implement section 26 is a hollow tube 92 instead of a rod. Other shapes and sizes can be used.

A spring 94 is disposed inside the paint applicator 20, with a first end 96 being attached at the distal end of the inner cylinder 58, and a second end 98 being attached at the proximal end of the implement section 26. The spring 94 can bias the paint applicator 20 in either the extended or retracted position, depending on user preference or application. A dampener could also be included to control the force of the spring 94. Other mechanisms will be apparent to those of ordinary skill in the art to bias the paint applicator 20 in either of the positions.

Figure 23:
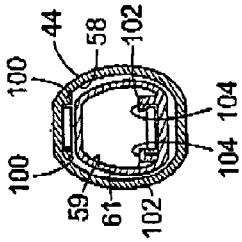
FIG. 23 is a cross sectional view of the paint roller of FIG. 22 taken along line 23—23.
Figure 22:
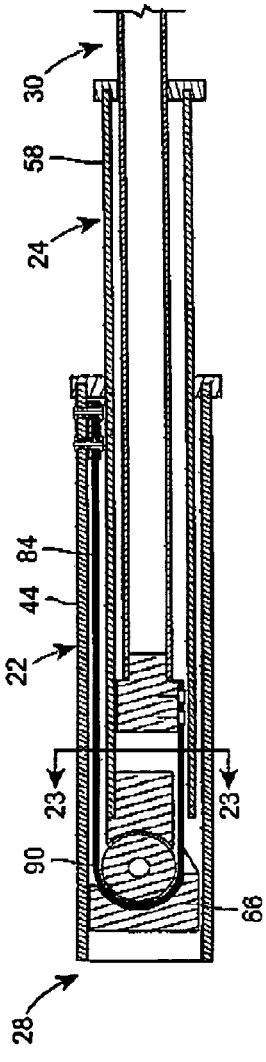
FIG. 22 is a partial cross sectional view of an alternative example of the paint roller of FIG. 1.

Referring now to FIGS. 22 and 23, another alternative example is shown. In this example, walls 100, 102 are constructed to surround the advancement strip 82 along its full length of travel. A first set of walls 100 extend inward from the inner surface 48 of the outer cylinder 44. The advancement tape 82 is captured by the outer surface 61 of the inner cylinder 58. A second set of walls 102 extend inward from the inner surface 96 of the implement section. The second set of walls 102 include fingers 104 that reach over the top of the advancement tape 82 to capture the advancement tape 82. An advancement strip 82 can thereby be used that is less resistant to buckling, because the walls 100, 102 support and prevent the advancement strip 82 from buckling. In this example, the advancement strip 82 can be made from plastic, wire, etc.

Figure 24:
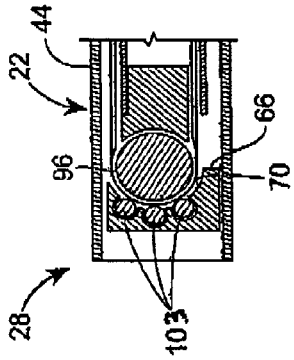
FIG. 24 is a partial cross sectional view of an alternative example of the paint roller of FIG. 1.

In a further alternative example, shown in FIG. 24, rolling element bearings 103 can be implemented on the pushing surface 70 of the guide block 66 to reduce friction between the pushing surface 70 and the advancement strip 82.

Figure 6:
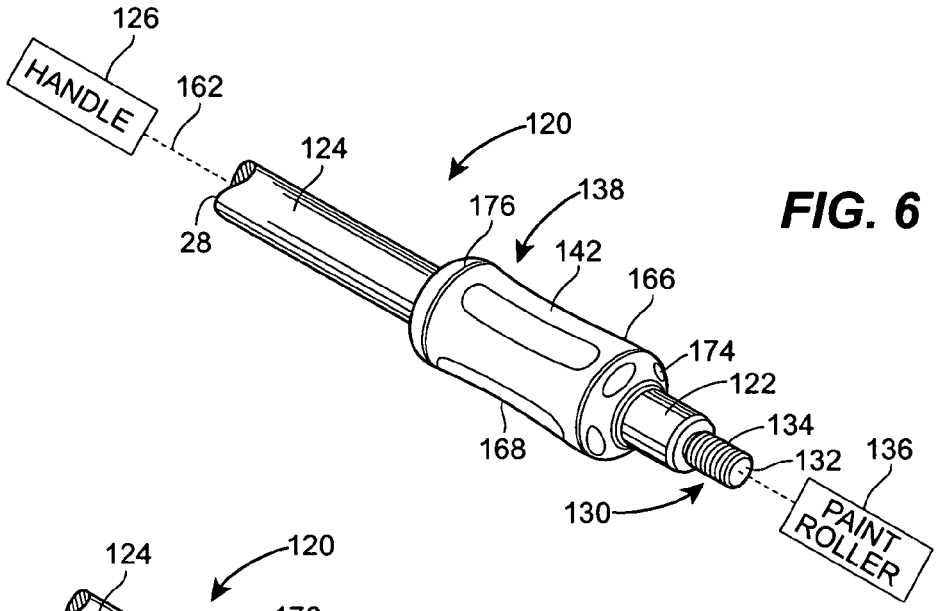
FIG. 6 is a fragmentary perspective view of a second example of an extension pole constructed in accordance with the teachings of the disclosure and depicted in a retracted state.

Referring now to FIG. 6, a second example of an extension pole constructed in accordance with the teachings of the disclosure is generally referred to by reference numeral 120. While the extension pole 120 will be described herein in reference to painting applications, it is to be understood that the pole 120 can be used in a variety of other settings wherein additional reach is advantageous. Such situations may include, but are not limited to, cleaning apparatus such as dusting tools, gardening apparatus such as tree trimmers, and warehousing tools such as stock retrieval arms.

Figure 7:
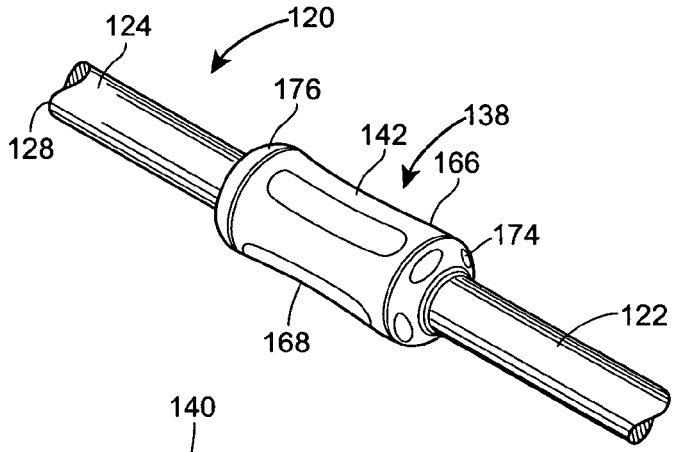
FIG. 7 is a fragmentary perspective view of an extension pole of FIG. 6, but depicted in a retracted state.

Referring again to FIGS. 6 and 7, the extension pole 120 is shown to include an inner tube 122 telescopically disposed, and slidable, within an outer tube 124. Accordingly, the extension pole 120 can be configured to be any dimension between the fully retracted position shown in FIG. 6 to the fully extended position shown in FIG. 7. In addition, while not depicted, it is to be understood that any number of tubes can be telescoped within one another, and be provided at various lengths. Accordingly, an additional outer tube (not shown) could be provided, with the outer tube 124 being slidably disposed therein.

The extension pole 120 further includes a handle 126 (shown schematically) provided at a proximal end 128 of the outer tube 124, and a mounting mechanism 130 provided at a distal end 132 of the inner tube 122. The mounting mechanism 130 may be provided in a variety of forms, but is depicted as including a plurality of external threads 134 adapted to be received into a paint roller 136 having a plurality of matching threads (not shown) in a handle thereof.

Referring now to FIGS. 8–11, a collet assembly 138 provided on the extension pole 120 is shown in detail. The collet assembly 138 is provided so as to enable a user to lock the extension pole 120 into any desired length after the inner tube is slid to the appropriate position relative to the outer tube 124. Beginning with FIG. 8, the collet assembly 138 is shown to include a collet lock 140 and a collet handle 142 adapted to slide over, and rotate relative to, the collet lock 140.

The collet lock 140 includes a cylindrical body 144 having a proximal end 146 and a distal end 148. Provided at the distal end 148 are a plurality of deflectable tabs 150 spaced about a circumference 151 of the cylindrical body 144 and separated by a plurality of reliefs 152. Provided within the cylindrical body 144 is a channel 154 having a first section 156, a second section 158, and a third section 160. Moreover, it will be noted that the first section 156 is substantially parallel to a longitudinal axis 162 of the extension pole 120, while the second and third sections, 158 and 160, respectively, run transverse to the longitudinal axis 162 and in the depicted embodiment are substantially perpendicular thereto. Directly within the second section 158, a locking ridge 164 is provided, the importance which will be discussed in further detail herein. It is further to be understood that an additional locking ridge (not shown) can be provided in the third section 160 as well.

With regard to the collet handle 142, it will be noted to include an outer body 166 having a substantially concave side wall 168. Moreover, the outer body 166 includes an inner diameter 170 slightly greater than outer diameter 172 of the collet lock cylindrical body 144. The outer body 166 further includes a distal end 174 and a proximal end 176, both of which are tapered, with an inside surface 178 of the distal end 174 acting as a cam, the importance of which will be discussed in further detail herein. Moreover, first and second locking knobs 182, 184 extend radially inwardly from an inside surface 186 of the side wall 168.

Figure 9:
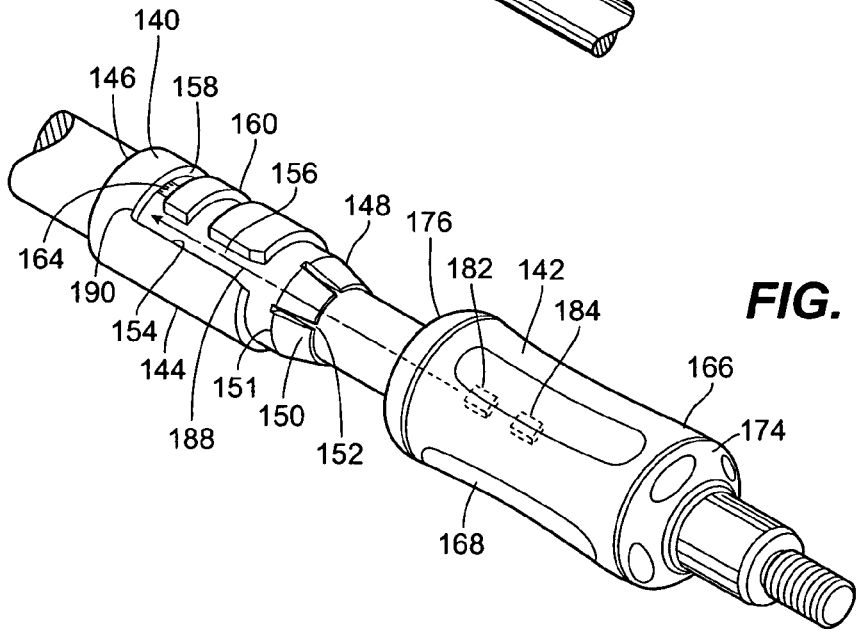
FIG. 9 is a fragmentary perspective view of the collet assembly of FIG. 8, and depicting the path of the collet handle.
Figure 8:
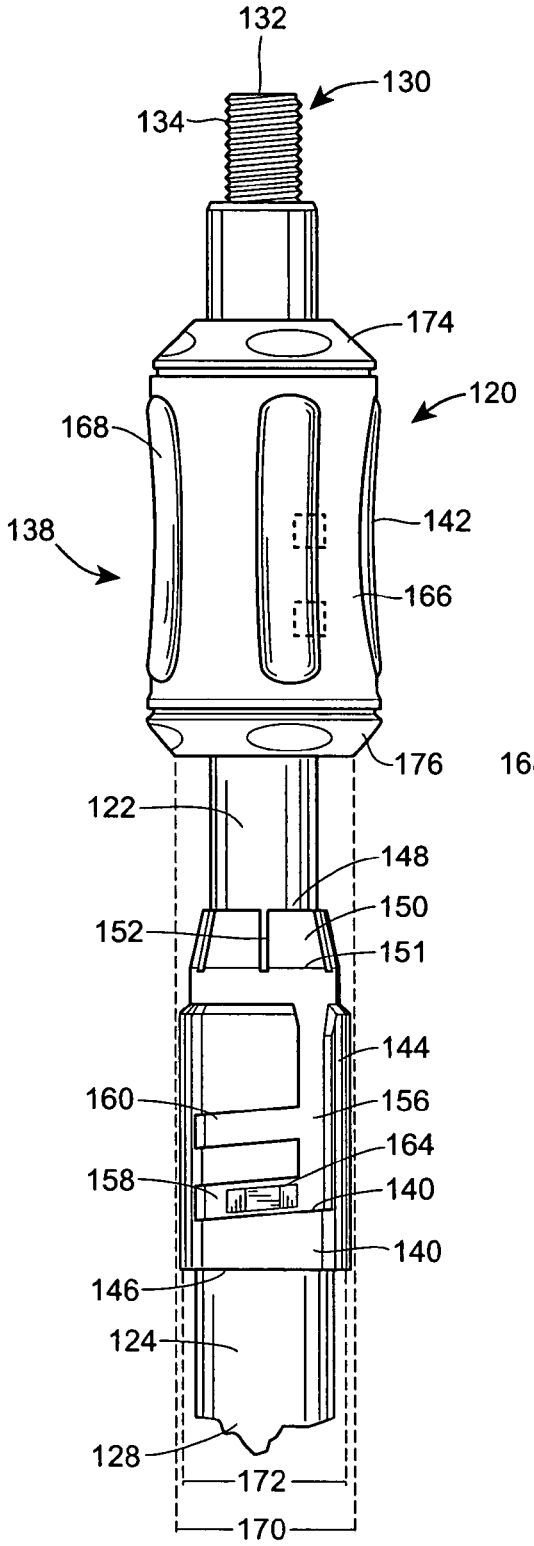
FIG. 8 is a fragmentary front view of a collet assembly constructed in accordance with the teachings of the disclosure and depicted in an unlocked state.
Figure 10:
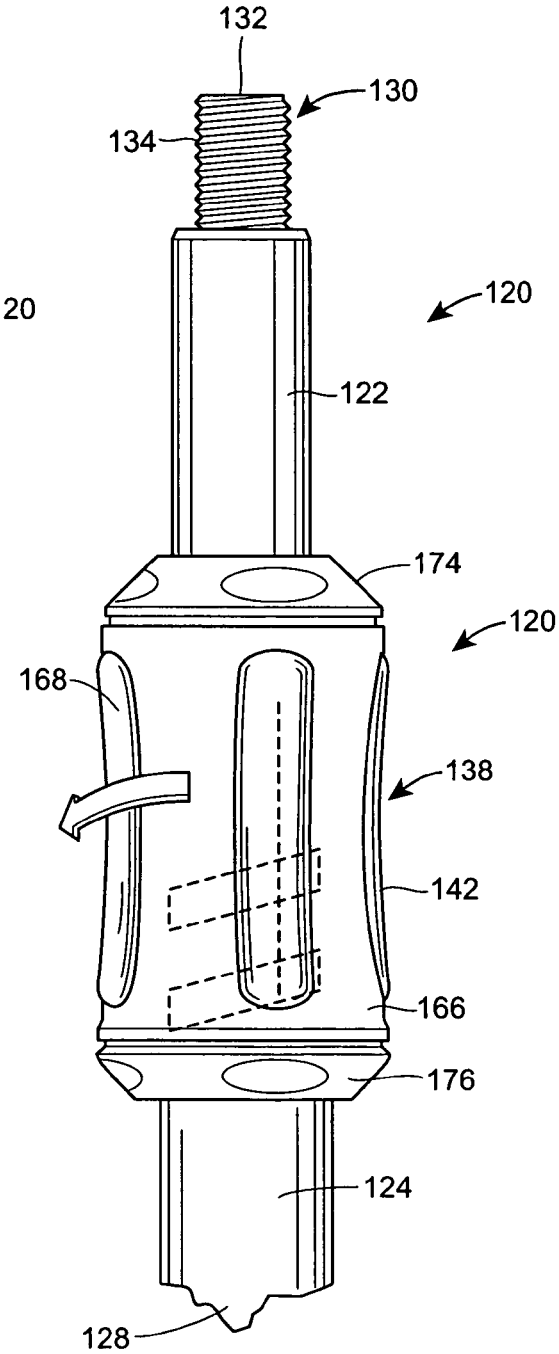
FIG. 10 is a fragmentary front view of the collet assembly of FIG. 8 and depicted in a locked state.
Figure 11:
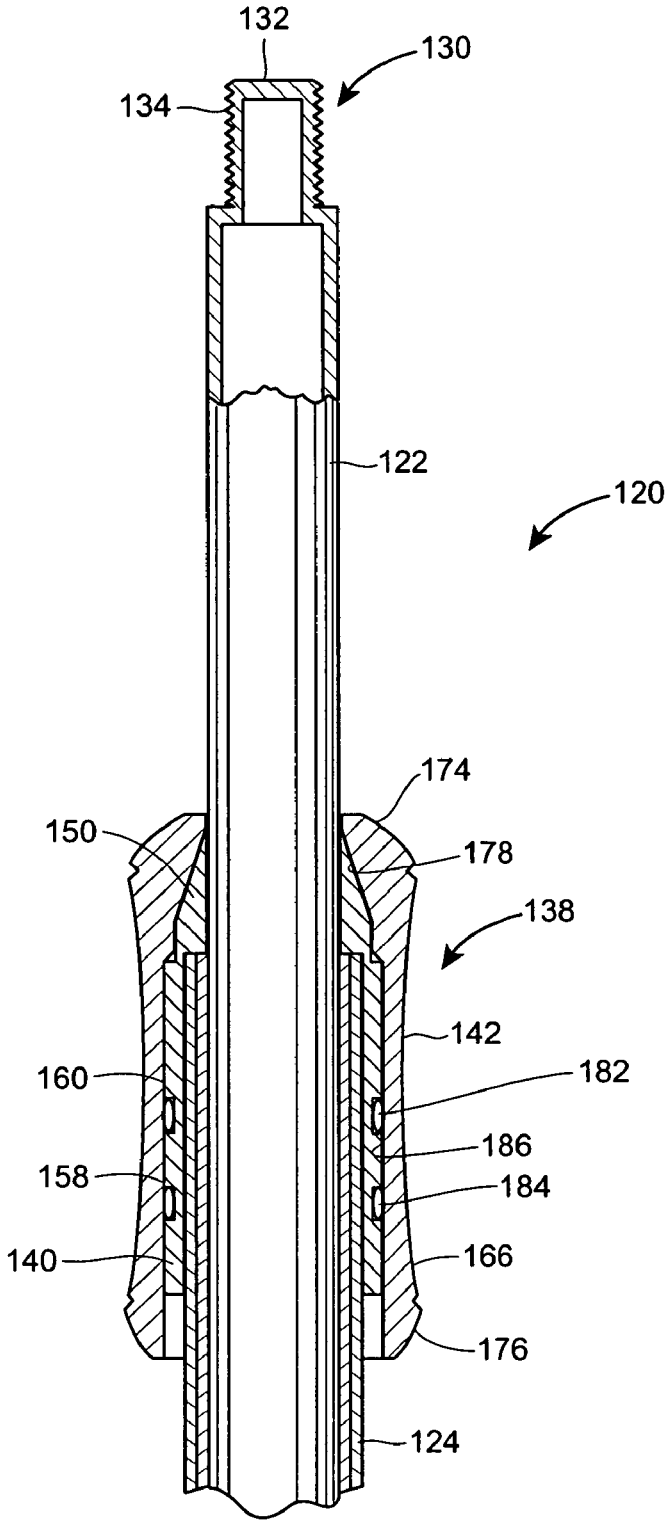
FIG. 11 is a fragmentary sectional view of the collet assembly of FIG. 10.

Referring now to FIGS. 9 and 10, the motion of the collet handle 142 relative to the collet lock 140 is shown in detail. It is to be understood that the collet lock cylindrical body is fixedly attached to the outer tube 124 of the extension pole by way of friction, adhesive, or the like, and that it is only the collet handle 142 which slides relative to the collet lock 140. Referring first to FIG. 9, the collet handle 142 is shown slid away from the collet lock 140 and, in so doing, the tabs 150 of the collet lock 140 do not significantly grip the inner tube 122 in such a position. The inner tube 122 can thereby be slid relative to the outer tube 124 and thus achieve the desired length of the extension pole 120. Once the desired length is achieved, the collet handle 142 is slid in the direction of arrow 188 as shown best in FIG. 9. In so doing, the locking knobs 182 and 184 slide within the first section 156 of the channel 154 until the locking knob 182 engages a back stop 190 forming a part of the second section 158. As indicated above the collet handle 142 is able to so slide over the collet lock 140 in that the inner diameter 170 of the collet handle 142 is greater than the outer diameter 172 of the collet lock 140. Once the collet handle 142 is fully slid onto the collet lock 140, the cam 180 formed by the inside surface 178 of the collet handle 142 engages the tabs 150 and pushes the tabs 150 radially inwardly as shown best in FIG. 11. Accordingly, the tabs 150 frictionally engage the inner tube 122 and thereby grip the inner tube 122 to the outer tube 124 in that the collet lock 140 is fixedly attached to the outer tube 124.

In order to positively lock the handle 142 against linear motion and into such a position relative to the collet lock 140, and thus positively lock the inner tube 122 to the outer tube 124, the collet handle 152 simply needs to be rotated a relatively short distance, (e.g., 60°–90° in the depicted embodiment), as shown best in FIGS. 9 and 10. In so doing, the locking knobs 182 and 184 slide within the second and third sections 158 and 160 of the locking channel 154. When rotated into such a position, the locking knobs 182 and 184 prevent the collet handle 142 from being pulled along the longitudinal axis 162 in that they engage the second and third sections 158 and 160 of the locking channel 154, respectively.

In order to positively lock the collet handle 142 against rotation, the locking ridge 164 is provided. More specifically, by rotating the collet handle 142 about the collet lock 140, the locking knob 182 is slid up and over the locking ridge 164. In order to rotate the collet handle 142 from the locked position to an unlocked position, relatively significant force must be exerted by the user so as to rotate the locking knob 182 up and over the locking ridge 164 in an opposite direction. The locking ridge 164 can be provided in a deflectable form to facilitate such rotation. Similarly, the locking knob 182 can also be provided in deflectable form on the collet handle 142. In a still further embodiment, a second locking tab (not shown) could be provided within the third section 160 to serve a similar role.

Not only does the locking knob 182 provide a means for locking the handle rotationally, but it also creates an audible and tactile cue to the user that a locked or unlocked position has been obtained. More specifically, motion of the locking knob 182 over the tab 164 creates a clicking sound which can be heard and felt by the user.

In operation, it can therefore be seen that the extension pole 120 can be used to provide the user with an infinitely variable length to facilitate painting operations such as using a paint roller attached to a distal end 132 of the extension pole 120. When the collet handle 142 is slid away from the collet lock 140, the inner tube 122 can be readily slid telescopically relative to the outer tube 124. Once the pole 120 is positioned at its desired length, the handle 142 can be slid onto the collet lock 140 to thus force the locking tabs 150 radially inwardly and thus to grip the inner tube 122 to the outer tube 124. The collet handle 142 can then be rotated from an unlocked position to a locked position wherein a locking knob 182 traverses up and over a locking tab 164 provided within a locking channel 54. In such a position, the inner tube 122 cannot be moved relative to the outer tube 124. When the painting application is completed, or when a different dimension is desired, the collet lock 142 can be easily and quickly rotated a relatively small number of degrees from a locked position to an unlocked position, wherein the locking knob 182 traverses up and over the locking tab 164 to thus enable the locking tab 182 to be slid along the first section 156 of the locking channel 154 and thus to remove the collet handle 142 from the collet lock 140. Once removed, the tabs 150 no longer engage the inner tube 122 and thus the inner tube 122 can be readily slid relative to the outer tube 124.

Figure 12:
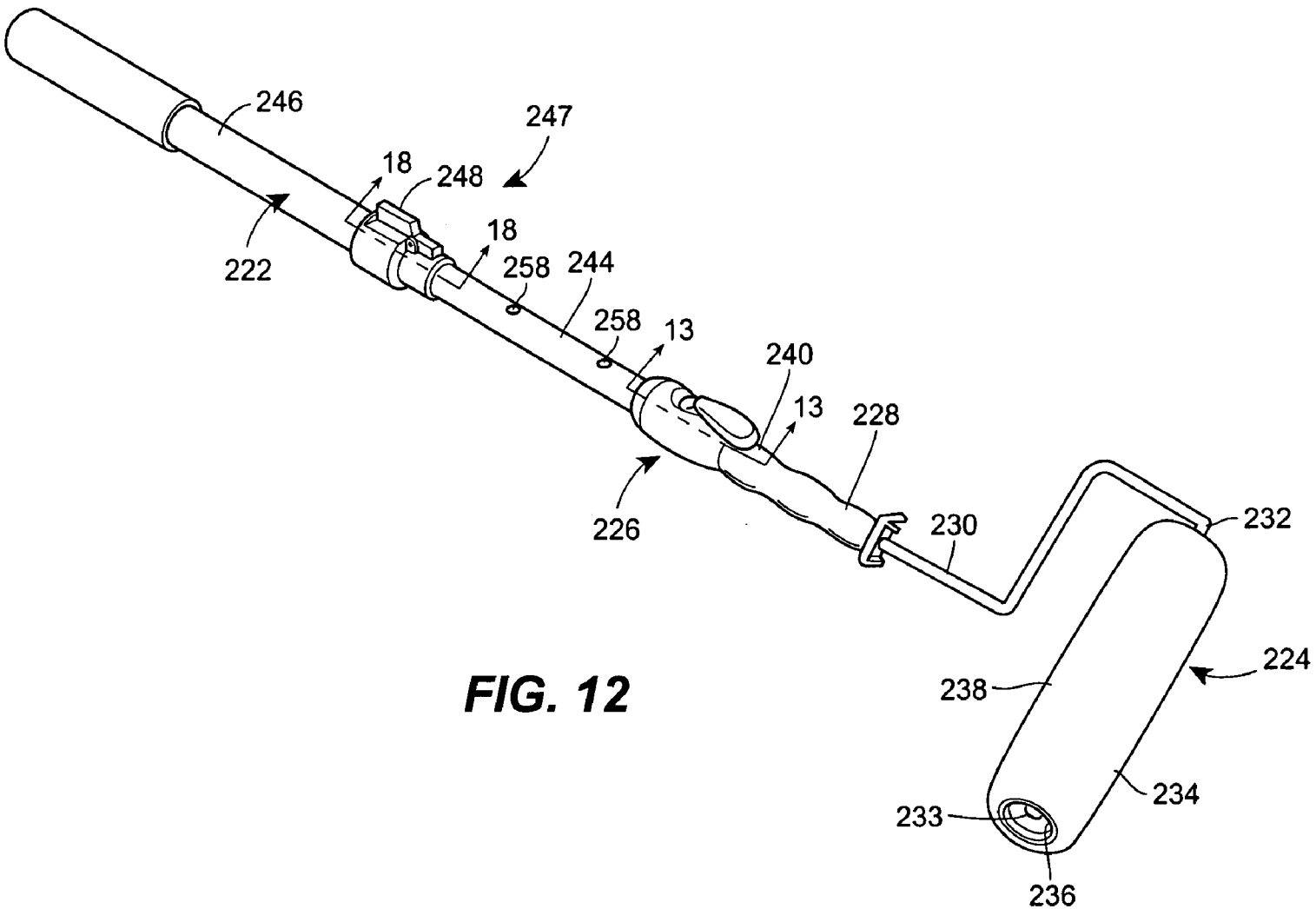
FIG. 12 is a perspective view of an extension pole and painting accessory assembly constructed in accordance with the teachings of the disclosure.

Referring now to FIG. 12, a third example of an extension pole and painting accessory assembly constructed in accordance with the teachings of the disclosure is generally referred to by reference numeral 220. While the following written description will be made, and depiction will be set forth in the drawings, as providing a mechanism for quickly attaching and detaching a paint roller from an extension pole, it is to be understood that the teaching of the disclosure can be used for quickly attaching and detaching any other tool to an extension pole as well, including but not limited to, paint pads, paint brushes, dusting tools, light bulb changers, etc.

As shown in FIG. 12, the painting accessory extension pole assembly 220 may include an extension pole 222, a paint roller 224 (or other accessories), and a connector or connection mechanism 226 for connecting a paint roller 224 to an extension pole 222. As is conventional, the paint roller 224 includes a handle 228 from which a rod 230 extends and forms a mounting axle 232 for rotatably supporting a cage 233 which in turn supports a paint roller cover 234. One of ordinary skill in the art will readily understand that the paint roller cover 234 may include a core 236 of plastic or paper origin and a fabric or foam mat or nap 238 for absorption and spreading of paint therefrom. As shown best in FIG. 15, the handle 228 terminates in a hollow end 240 having a plurality of internal threads 242, the importance of which will be discussed in further detail herein.

Figure 18:
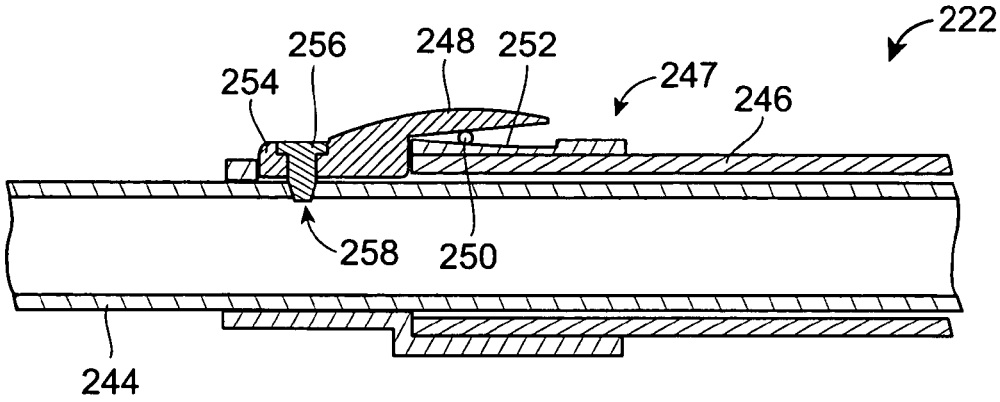
FIG. 18 is a sectional view of the extension pole of FIG. 12, and taken along line 18—18 of FIG. 12.
Figure 19:
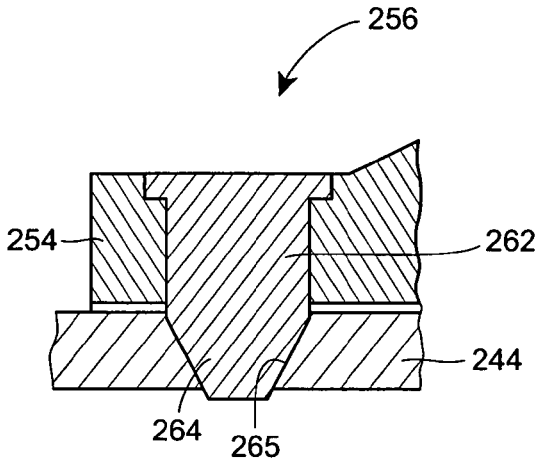
FIG. 19 is an enlarged fragmentary sectional view of the extension pole tooth of FIG. 18.

With regard to the extension pole 222, it includes an inner tube 244 telescopically mounted within an outer tube 246. Accordingly, the inner tube 244 can be slid out from the outer tube 246 to any desired dimension and secured into such a dimension by any number of fastening devices. In the depicted embodiment, as shown best in FIGS. 12 and 18, a locking mechanism 247 may be provided to secure the inner and outer tubes 244, 246 into a given position. The locking mechanism 247 may be provided in the form of a spring biased arm 248 pivotably attached to the outer tube 246 at a pivot 250 and biased into a locking position by a spring 252. Extending from a free end 254 of the arm 248 is an engagement tooth 256 adapted to interfit into any one of a number of apertures 258 provided in and spaced along the inner tube 244.

While such a connection mechanism 247 may be conventional, the shape and form of the tooth 256 is not. As opposed to prior art devices which use cylindrical teeth, it will be noted that the tooth 256 is substantially conical or frustoconical in shape having a cylindrical base 262 from which a frustoconical section 264 extends. In addition, the apertures 258 provided within the inner tube 244 include chamfered, canted, or tapered side walls 265 so as to be complementary to, or congruent with, the frustoconical shape of the tooth 256. Accordingly, as shown best in FIG. 18, when the tooth 256 is secured within one of the apertures 258, it is tightly or snuggly received therein, thus removing or alleviating any slop or play associated with prior art securement devices. The resulting assembly 220 is therefore more rigid and reliably holds its dimension and attached tool, thus improving performance and user satisfaction.

Figure 13:
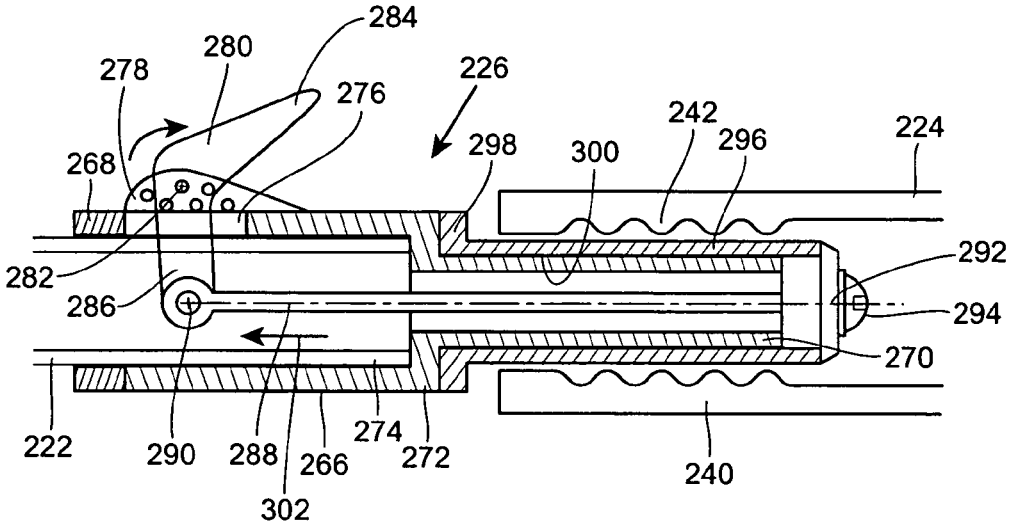
FIG. 13 is a sectional view of the assembly of FIG. 12, taken along line 13—13 of FIG. 12, and depicted in an unlocked state.
Figure 14:
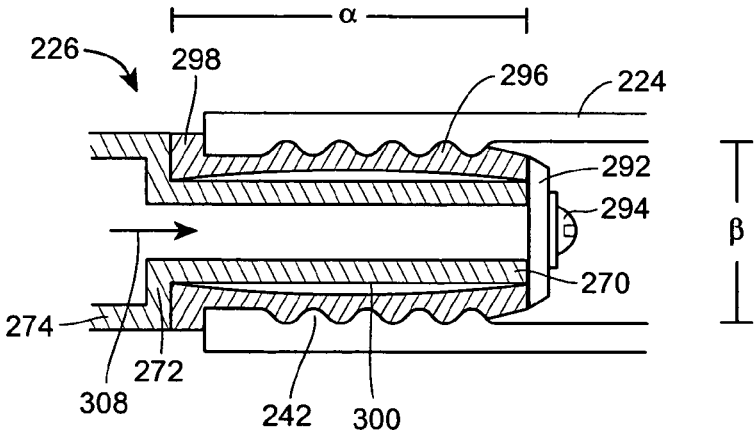
FIG. 14 is a sectional view of the assembly of FIG. 12, also taken along line 13—13 of FIG. 12, but depicted in a locked state.

Referring now to FIGS. 13 and 14, the connector 226 used for quickly attaching the painting accessory 224 to the extension pole 222 is shown in further detail. More specifically, the connector 226 is shown in an unlocked or disengaged configuration in FIG. 13, and a locked or engaged position in FIG. 14 wherein the extension pole 222 is secured to the painting accessory 224. The connector 226 includes a housing 266 having an enlarged diameter, attachment end 268, a reduced diameter insertion end 270, and a central shoulder 272 therebetween. As shown, the enlarged diameter end 268 is sized to be frictionally mounted onto a distal end 274 of the inner tube 244 of the extension pole 222. Any number of adhesives or epoxies may also be used to fully secure the connector 226 to the pole 222.

Extending through a portion of the enlarged diameter end 268 is an aperture 276 having a mounting boss 278 proximate thereto. As one of ordinary skill is the art will readily understand the mounting boss 278 may be integrally molded with the housing 266 as from polypropylene or other suitable plastics.

Connected to the mounting boss 278 is locking lever 280 pivotally mounted thereto at a pivot point 282. The locking lever 280 is substantially L-shaped including a long leg 284 and a short leg 286. The short leg 286 is pivotally connected to an actuation rod 288 at a pivot point 290. The actuation rod 288 extends from the enlarged diameter end 268 to the insertion end 270 and is connected to a compression cap 292 by way of a fastener 294 such as a threaded screw or the like.

Mounted around the insertion end 270 is an elastomeric sheath 296 made of rubber or other suitable elastomer. More specifically, the sheath 296 includes a shoulder end 298 adhesively secured to the shoulder 272 and to the compression cap 292. However, as shown best in FIG. 14, the sheath 296 is not secured to a cylindrical outer surface 300 of the insertion end 270. Accordingly, when the actuation rod 288 is pulled in a direction of arrow 302, it can be seen, in a comparison in FIGS. 13 and 14, that the elastomeric sheath 296 is able to bow outwardly as its length a is decreased due to the compression cap 292 pulling against the sheath 296. In so doing, it will be appreciated that not only does the length $\alpha$ of the sheath 296 shorten, but that its outer diameter $\beta$ increases. This is of importance in that it enables the material of the elastomeric sheath to engage with threads 242 of the painting accessory 224. In so doing, such a connector 226 enables the extension pole 222 to be connected to any number of differently sized painting accessories. To release the connector 226, the locking lever 280 simply needs to be rotated in the opposite direction to thereby force the actuation rod 288 in the direction of arrow 308. In so doing, the elastomeric sheath 296 is able to revert to its natural state, greater length and a lesser diameter, aided by the fact that the sheath 296 is secured both to the shoulder 272 and the compression cap 292 which in turn stretches the elastomeric sheath 296 taught against the cylindrical surface 300 of the insertion end 270.

Any number of different mechanisms may be provided to pivotally mount the locking lever 280 to the mounting boss 278, and the actuator rod 288. For example, while not depicted, a two-piece over-center linkage assembly may be employed having a first link connected to both the actuation rod 288 and the locking lever 280. A second linkage may then be interconnected to the locking lever 280 and the housing 266. In so doing, when the locking lever 280 is pivoted away from the housing 266, the first and second links and will pivot into approximately a 90° angle relative to one other, thereby allowing the actuation rod 288 to be pulled into the housing 266. However, when the locking lever 288 is pivoted toward the housing 266, the first and second links are moved into a parallel configuration in alignment with the actuation rod 288 to thus lock the painting accessory 224 to the extension pole 222.

Figure 15:
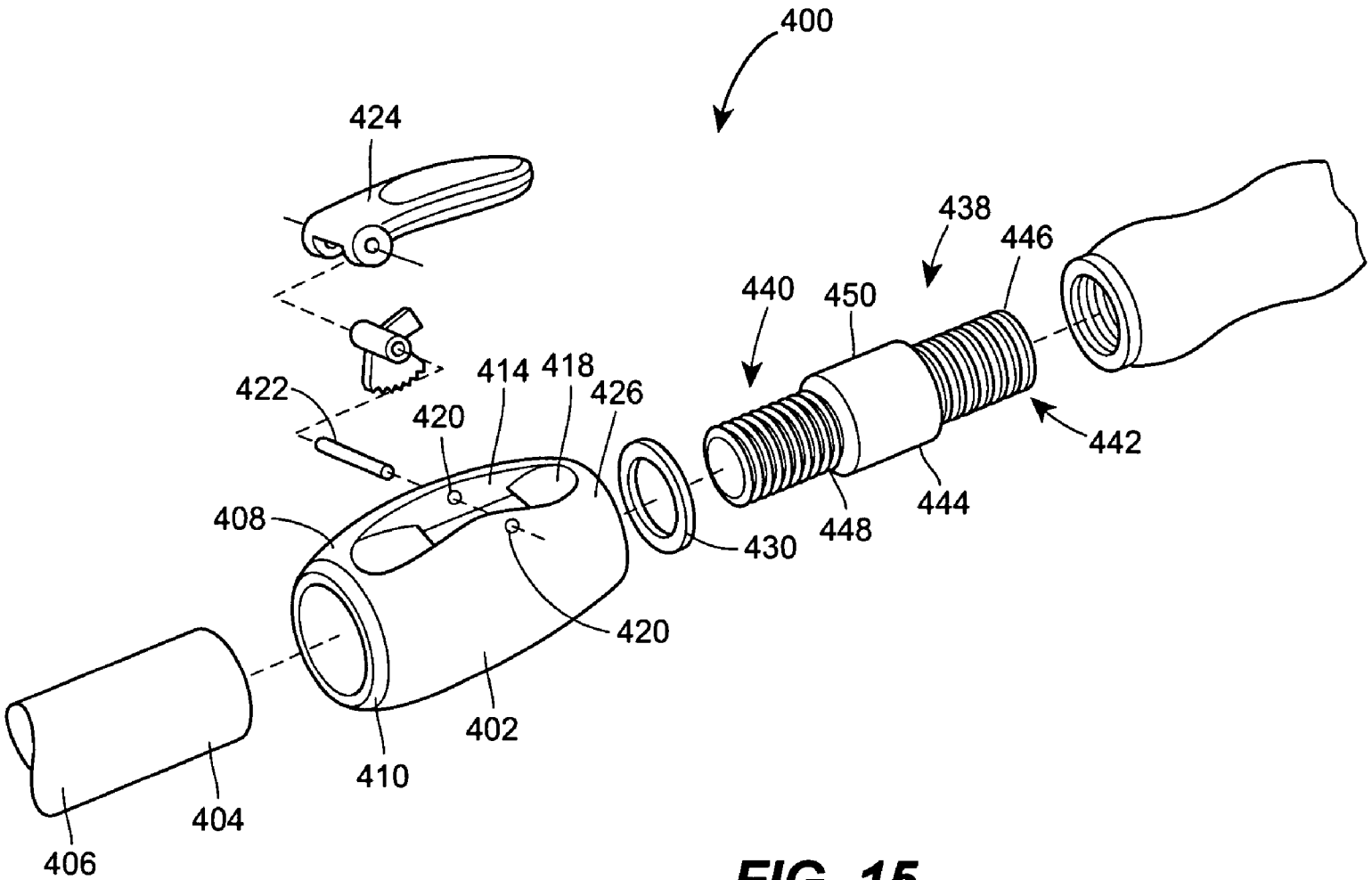
FIG. 15 is an exploded view of an alternative assembly according to the teachings of the disclosure.
Figure 16:
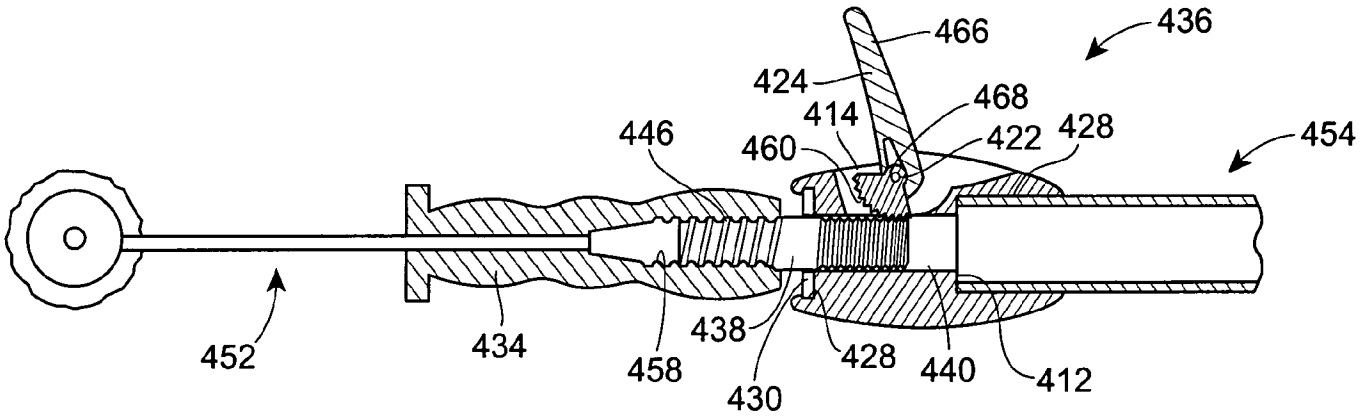
FIG. 16 is a sectional view of the assembly of FIG. 15, taken along a line similar to line 13—13 of FIG. 12, and depicted in an unlocked state.
Figure 17:
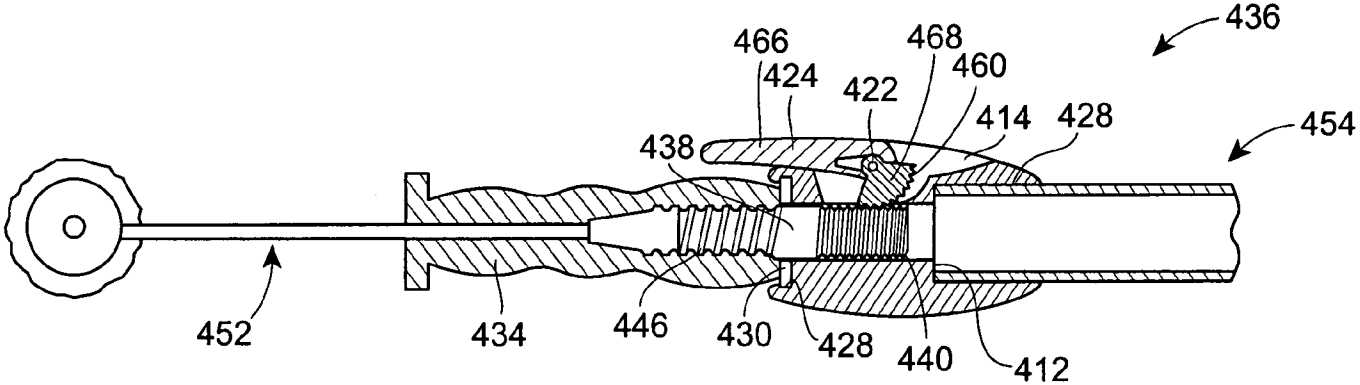
FIG. 17 is a sectional view similar to FIG. 16, but depicted in a locked state.

Referring now to FIGS. 15–17, an alternative connector 400 for quickly attaching a painting accessory to an extension pole is shown in further detail. The connector 400, more specifically, may include a housing 402 adapted to be mounted onto a distal end 404 of an extension pole inner tube 406. The housing 402 may include a substantially cylindrical outer shell 408 having a first end 410 of a diameter slightly greater than the distal end 404 of the inner tube 406. Accordingly, the first end 410 can be slid over the distal end 404 and be frictionally engaged thereto. The mounting of the housing 402 onto the distal end 404 can be further enhanced by the use of adhesive or the like. As shown best in FIG. 16, the housing 402 may further include an interior stop 412 to provide a positive surface against which the distal end 404 can be secured.

The housing 402 may further include a side channel 414 having a through hole 418 and a pair of pivot apertures 420. The pivot apertures 420 are adapted to receive a pivot pin 422 for rotatable mounting of a cam lever 424 thereto.

At a second end 426 of the housing 402, an annular recess 428 (see FIG. 17) may be provided for frictional receipt of an elastomeric grommet or washer 430 having an interior diameter 432. The washer 430, similar to the stop 412, provides a surface against which a roller handle 434 can be rested when fully attached to the assembly 436.

The assembly 436 further includes an adapter 438 having a first end 440, a second end 442, and a central section 444. The first end 440 may include a plurality of threads 446, while the second end 442 may include a plurality of ribs 448, while the center section 444 may include a substantially smooth exterior wall 450.

Using the foregoing structure, it can be seen by one of ordinary skill in the art that a painting accessory or roller 452 can be easily and quickly attached to an extension pole 454 to thereby facilitate use in an actual painting application. More specifically, through the assembly 436, the paint roller 452 can be quickly and repeatedly removed from the extension pole 454.

The assembly 436 is able to do so by employing, among other things, the adapter 438 in the handle 456 of the paint roller 452. In order to do so, threads 446 of the adapter 438 are sized so as to be complementary to internal threads 458 of the paint roller handle 456. Accordingly, the adapter 438 can be rotated and threadably attached to the paint roller 452 for subsequent and repeated use in that the second end 442 remains extending from the paint roller 452.

When it is desired to mount the paint roller 452 to the extension pole 454, the second end 442 of the adapter 438 can simply be inserted into the second end 426 of the housing 402. The second end 442 of the adapter end 438 has a diameter slightly less than the internal diameter of the housing 402.

The adapter 438 is slid into the housing 402 until the paint roller 452 engages the washer 430. The roller 452 can then be securely attached to the extension pole 454 simply by rotating the cam lever 424 from the unlocked position depicted in FIG. 16, to the locked position depicted in FIG. 17. In so doing, it will be noted that teeth 460 of the cam lever 424, which engage the ribs 440 of the adapter 438 upon sliding of the adapter 438 into housing 402, rotate and thus push the adapter 438 into the housing 402. Such action causes the cylindrical side wall 444 to slide against the inner diameter 432 of the washer 430 in a frictionally interfit arrangement.

Moreover, the cam lever 424 is locked into such a position as that shown in FIG. 17, not only given the presence of the teeth 460 and the ribs 462, but also the shape of the cam lever 424. The cam lever 424 may actually include a cam arm 466 to which a cam insert 468 is attached as shown best in FIG. 15. In order to prolong the serviceable life of the assembly 436, the insert 468 may be provided in the form of a die cast metal part for later attachment to the cam arm 462 using the pin 422.

From the foregoing, one of ordinary skill in the art will appreciate that the present disclosure sets forth a paint roller that can easily extend to reach remote areas. However, one of ordinary skill in the art could readily apply the novel teachings of this disclosure to any number of situations in which an extendable pole is desirable. This includes, but is not limited to, glass cleaners, booms, brooms, camera tripods, garden tools, etc. As such, the teachings of this disclosure shall not be considered to be limited to the specific examples disclosed herein, but to include all applications within the spirit and scope of the invention.

I claim:

1. An extendable handle, comprising:

a first shaft having a distal end and a proximal end;

a second shaft having a distal end and a proximal end and slidably disposed within the first shaft;

a guide block disposed on the distal end of the second shaft and having a curved surface thereon;

a third shaft with a distal end and a proximal end and slidably disposed within the second shaft; and an advancement strip with a first end and a second end, wherein the first end of the advancement strip is connected to the distal end of the first shaft and the second end of the advancement strip is connected to the proximal end of the third shaft, and wherein the advancement strip is disposed along the curved surface of the guide block;

wherein the advancement strip can both pull and push the third shaft relative to the second shaft.

2. The handle of claim 1, further comprising an ergonomic grip disposed on the first shaft and an ergonomic grip disposed on the second shaft.

3. The handle of claim 1, wherein the handle includes means for preventing relative movement between the first shaft and the second shaft.

4. The handle of claim 3, wherein the means comprise a locking pin, wherein the second shaft includes a plurality of holes, and the first shaft includes a locking hole.

5. The handle of claim 4, wherein the locking pin is biased toward the second shaft by a spring.

6. The handle of claim 1, wherein the advancement strip is constructed of spring steel, a push-pull chain, or plastic.

7. The handle of claim 1, wherein the third shaft includes a mounting block that is slidable within the second shaft.

8. The handle of claim 1, further comprising a paint roller rotatably mounted on the distal end of the third shaft.

9. The handle of claim 1, further comprising a removable butt cap mounted to the proximal end of the first shaft.

10. A paint applicator with an extendable handle, comprising:

an outer shaft having a distal end and a proximal end;

an inner shaft having a distal end and a proximal end and telescopically disposed within the outer shaft;

a guide block attached to the inner shaft and having a curved surface thereon;

a rod with a distal end and a proximal end and telescopically disposed within the inner shaft;

an advancement strip with a first end and a second end, wherein the first end of the advancement strip is connected to the distal end of the outer shaft and the second end of the advancement strip is connected to the proximal end of the rod, and wherein the advancement strip is disposed along the curved surface of the guide block; and a paint roller rotatably mounted to the distal end of the rod;

wherein the advancement strip can both pull and push the rod relative to the inner shaft.

11. The paint applicator of claim 10, further comprising an ergonomic grip disposed on the outer shaft and an ergonomic grip disposed on the inner shaft.

12. The paint applicator of claim 10, further comprising means for preventing relative movement between the inner shaft and the outer shaft.

13. The paint applicator of claim 12, wherein the means comprise a locking pin, wherein the inner shaft includes a plurality of holes, and the outer shaft includes a locking hole.

14. The paint applicator of claim 13, wherein the locking pin is toward the inner shaft by a spring.

15. The paint applicator of claim 10, wherein the advancement strip is constructed of a spring steel.

16. The paint applicator of claim 10, wherein the rod includes a mounting block that is slidable within the inner shaft.

17. The paint applicator of claim 10, further comprising a removable butt cap mounted to the proximal end of the outer shaft.

* * * * *